United States Patent [19]

Ikes et al.

[11] Patent Number: 5,004,952

[45] Date of Patent: Apr. 2, 1991

[54] VACUUM-TIGHT WINDOW FOR MICROWAVE ELECTRON TUBE AND TRAVELLING WAVE TUBE INCLUDING THIS WINDOW

[75] Inventors: Jacques Tikes, Orsay; Joel Le Fur, Chilly-Mazarin; Pierre Nugues, Auneaux, all of France

[73] Assignee: Thomson-CSF, Puteaux, France

[21] Appl. No.: 431,390

[22] Filed: Nov. 3, 1989

[30] Foreign Application Priority Data

Nov. 4, 1988 [FR] France ..... 8814417

[51] Int. Cl.[5] ..... H01J 23/42

[52] U.S. Cl. ..... 315/3.5; 315/39.3; 333/252

[58] Field of Search ..... 333/252, 33, 34, 35; 315/3.5, 3.6, 39.3, 39.53

[56] References Cited

U.S. PATENT DOCUMENTS

| | | | |
|---|---|---|---|
| 2,611,102 | 9/1952 | Bohlke | 315/3 |
| 2,692,351 | 10/1954 | Morton | 315/3.5 |
| 2,785,244 | 8/1956 | Dodds | 315/3.5 |
| 2,824,289 | 2/1958 | Murdock | 333/227 |
| 2,867,747 | 1/1959 | Murdock | 315/5.38 |
| 2,947,907 | 8/1960 | Bodmer | 315/3.5 |
| 3,076,156 | 1/1963 | Muller et al. | 315/3.5 |
| 3,195,006 | 7/1965 | Sullivan et al. | 315/3.5 |
| 4,138,625 | 2/1979 | Koyama et al. | 315/3.5 |

FOREIGN PATENT DOCUMENTS 1075546 10/1954 France .

*Primary Examiner*—Eugene R. Laroche
*Assistant Examiner*—Seung Ham
*Attorney, Agent, or Firm*—Oblon, Spivak, McClelland, Maier & Neustadt

[57] ABSTRACT

The disclosure concerns microwave tubes and, more particularly, travelling wave tubes wherein the region under vacuum is isolated from the external HF input-/output circuits by vacuum-tight windows. The disclosed window consists of a ceramic cylinder, the two ends of which bear metallic flexible rings. This window is brazed to the cylindrical chamber of the part under vacuum by means of a clearance machined in the chamber, so that the chamber and the window are integrated and coaxial. The HF transmission through the window is achieved by means of an antenna formed by a metallic strip mounted, at right angles, on a metallic cylinder that fits the chamber. The device can be applied to power microwave tubes and, notably, to travelling wave tubes.

6 Claims, 3 Drawing Sheets

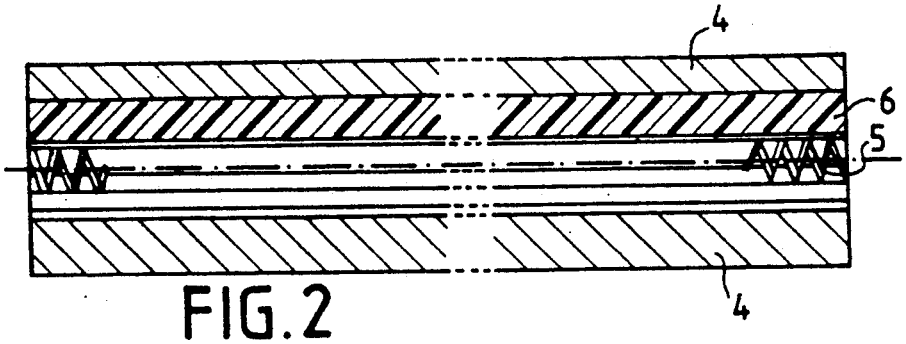
FIG. 2
PRIOR ART
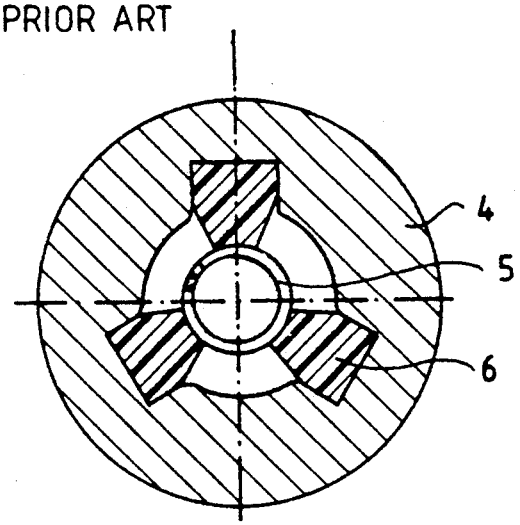
FIG. 3
PRIOR ART
FIG. 8
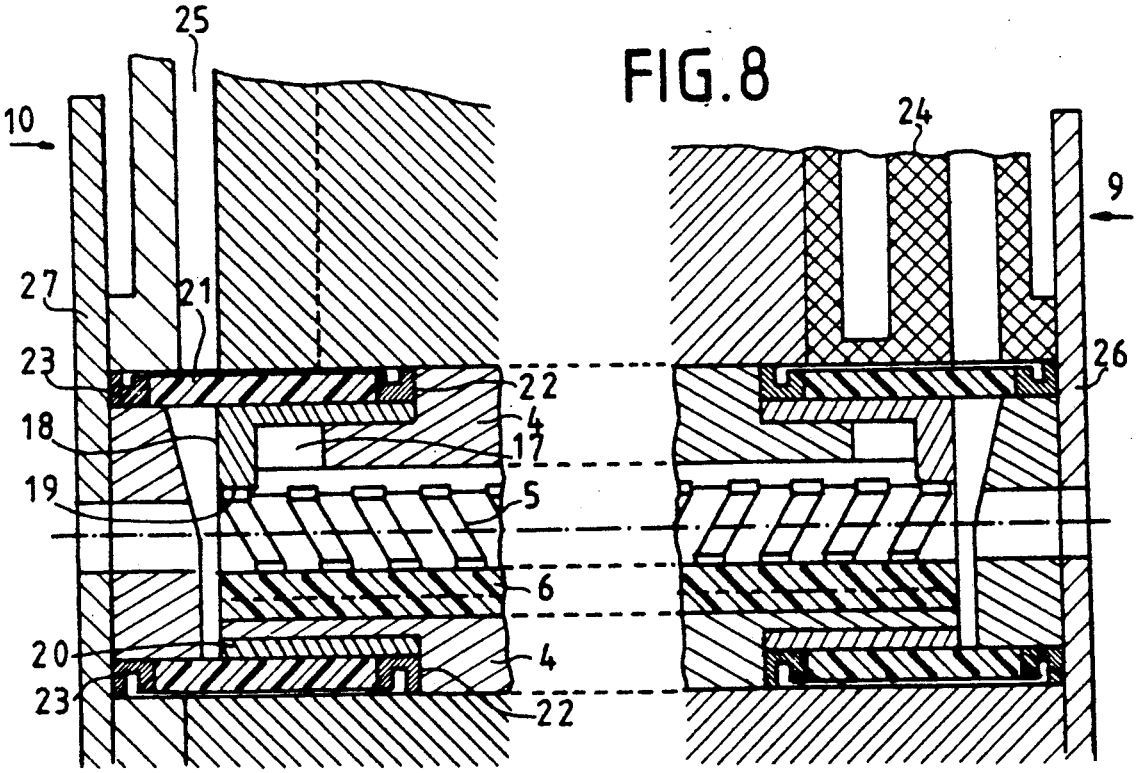

VACUUM-TIGHT WINDOW FOR MICROWAVE ELECTRON TUBE AND TRAVELLING WAVE TUBE INCLUDING THIS WINDOW

BACKGROUND OF THE INVENTION

1. Field of the Invention

The present invention concerns a vacuum-tight window for a travelling wave tube. This vacuum-tight window has the particular feature of being integrate with the chamber of the delay line and coaxial with the casing of the delay line. The window according to the invention takes the form of a cylinder which, in being interposed between the delay line and at least one of the ends of the travelling-wave tube (TWT), enables the vacuum to be maintained only in the minimum volume crossed by the electron beam.

2. Description of the Prior Art

A TWT is a tubular microwave device having an electron gun or source at a first end. The suitably focused electron beam goes through a delay line in which a metallic helix is kept in a centered position by dielectric rods. When they come out of the delay line, the electrons are absorbed by a collector connected to the ground.

A TWT is an amplifier for a microwave signal applied to a first end of the helix, for example by means of a coaxial line. By interaction with the electron beam, the microwave signal slows down the electrons, but is amplified and collected at the second end of the helix, for example by means of a waveguide. There are, therefore, two external transmission circuits for one TWT.

In the prior art, the travelling wave tubes are connected to external transmission circuits having a window that provides the vacuum tightness of the tube.

The parts "under vacuum" therefore include not only the travelling wave tube itself but also the parts of the external transmission circuits up to their window: this is unnecessary for the working of the tube. These windows are subjected to mechanical stresses when they are connected with load circuits. The stresses may be permanent and, at worst, they may cause leaks. Besides, these windows considerably increase the space occupied by the travelling wave tube.

SUMMARY OF THE INVENTION

According to the invention, the windows are brought to the TWT itself, and the HF input and the HF output, i.e. both external transmission circuits, are obtained through the windows, which are ceramic tubes, brazed to the delay line and to the casing of the gun and/or the collector, so that the part of the TWT kept under vacuum is restricted to a cylinder which goes from the gun to the collector. No ancillary volumes, corresponding to the external circuits, are any longer under vacuum.

The energy is transmitted between the external circuits and the helix of the TWT by means of antennas that radiate through the ceramic window or windows coaxial with the delay line: these antennas, which are brazed to the ends of the helix, form an integral part of the windows.

More precisely, the invention concerns a vacuum-tight window for a microwave electron tube comprising, firstly, a zone under vacuum, formed by a source of electrons, a focusing unit called a "delay line" and an collector of electrons and, secondly, at least one external transmission circuit through which a microwave signal interferes with the beam of electrons crossing the delay line, which is cylindrical, wherein this vacuum-tight window is also cylindrical, coaxial with the chamber that encases the delay line, and integrated with said chamber by brazing, the window being made of a ceramic material transparent to microwaves.

BRIEF DESCRIPTION OF THE DRAWINGS

The invention will be understood more clearly from the following description of an application to a high-power TWT. This description is based on the appended figures, of which:

FIGS. 2 and 3 show longitudinal an cross-sectional views of the delay line of a TWT according to the prior art;

FIG. 8 shows a sectional view of the ends of the delay line of a TWT according to the invention

DESCRIPTION OF PREFERRED EMBODIMENTS

Depending on its configuration (with coaxial lines or with waveguides), and on the power brought into play, a power TWT may comprise:

- a single window according to the invention if it has only one HF output per waveguide;
- or two windows if it has two waveguides or one waveguide and one coaxial line with a volume such that it is preferable to isolate it by a window from the circuit under vacuum.

However, with a view to simplifying the explanation of the invention, it shall be described in assuming that the TWT has two windows according to the invention, and one HF input per coaxial line and one HF output per waveguide, without prejudice to the scope of the invention.

Figure 1:
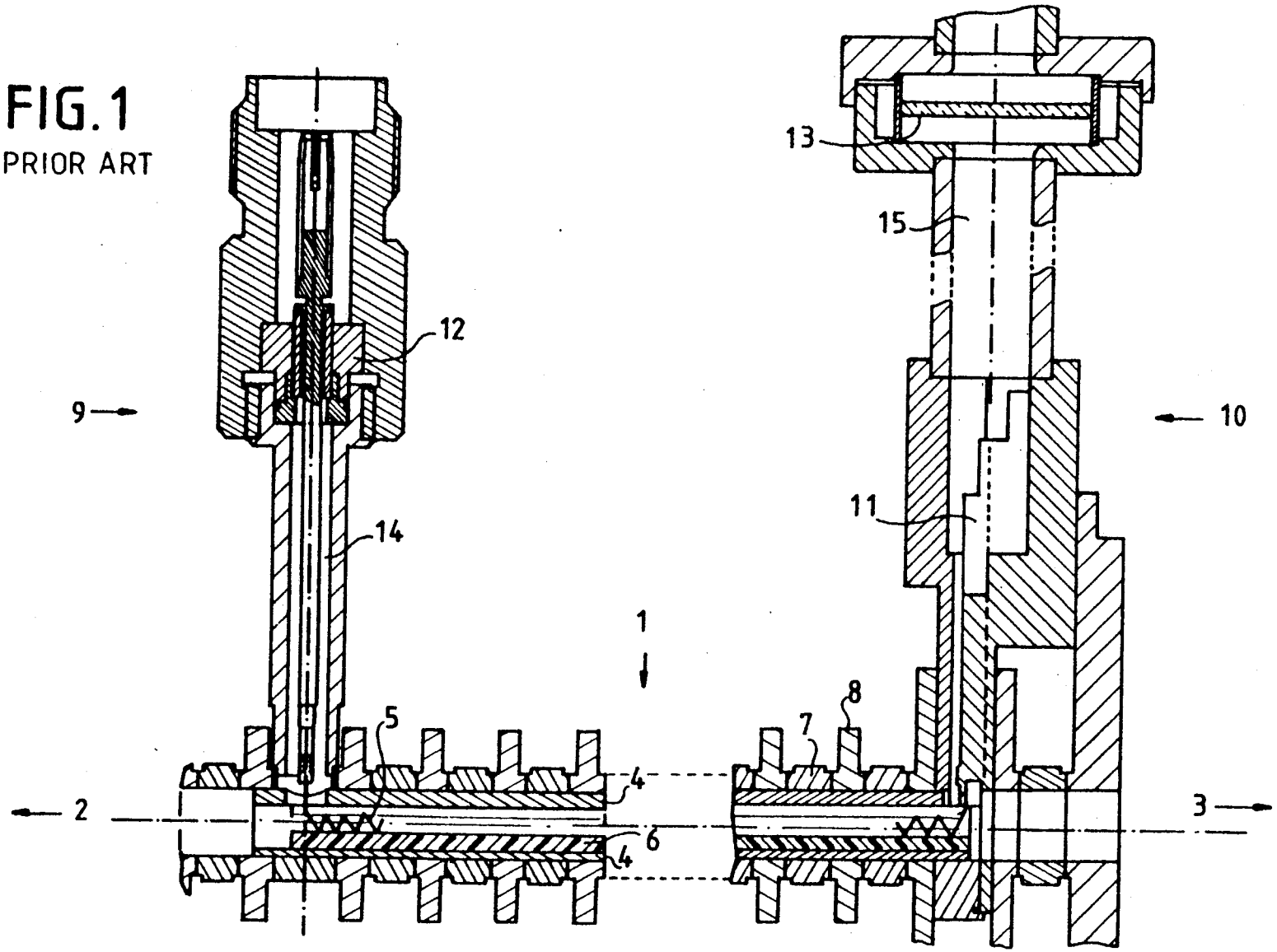
FIG. 1 PRIOR ART
FIG. 1 shows a sectional view of a prior art TWT.

Similarly, the invention shall be better understood after a preliminary reminder of the structure of a standard TWT shown in FIG. 1.

A travelling wave tube comprises a tubular central part, called a delay line 1.

A first end of this tube, a source or gun 2, emits a beam of electrons, which are collected at the second end of the tube by a collector 3 connected to the ground.

The delay line 1 itself has a tube or chamber 4, within which a helix 5, which is a metallic spiral, is kept in a central position by dielectric rods 6. These parts are better seen in FIGS. 2 and 3 which show an enlargement of the delay line 1.

The chamber 4 supports, externally, a plurality of toruses 7 which center toric magnets (not shown) and a plurality of pole pieces 8: the assembly is used to focus the beam of electrons emitted by the source 2.

A microwave signal is applied, on the source side, to a first end of the helix 5, for example by means of a coaxial line 9, called an HF input. The amplified signal is collected, on the collector side, at the second end of the helix 5 by means of a waveguide 10, called an HF output, within which a ridged part 11 is brazed to the helix 5 and acts as an antenna. The HF input has an input window 12 and the HF output has an output window 13.

The vacuum-tightness of the tube is ensured by these two microwave windows placed at the end of the external transmission circuits. These windows, which are well known in the prior art, are of the coaxial type or, for example, of the "Pill Box" type depending on the nature of the external circuits with which they are associated.

It is known that the coaxial type window is particularly brittle and that the "Pill Box" type window is costly. The junctions of the delay line and of the two external transmission circuits are the object of two French patents filed on behalf of THOMSON-CSF under numbers 8014351 and 8617879.

The problem resolved by the invention relates to the volumes 14 and 15, internal to the HF input and HF output: these volumes (especially where there are waveguides) considerably increase the space in which the vacuum has to be maintained.

The invention enables solely those parts needed for the working of the travelling wave tube to be kept under vacuum and also makes the windows incorporated in the external transmission circuits unnecessary. It consists in integrating a microwave window with the chamber 4 of the delay line 1. This window is very simple to make: it is a hollow dielectrical cylinder, brazed, at one end, to the helix chamber 4 and, at the other end, to the casing of the source 2 of the collector 3, as the case may be. The vacuum is thus restricted to the space comprising the source 2, the interior of the chamber 4 and the collector 3.

The following advantages result therefrom:

- the vacuum is easier to obtain because of the elimination of volumes to be put under vacuum;
- there are fewer risks of leakage;
- the mechanical stresses inherent in the connections with the load circuits no longer have any effect on the vacuum tightness of the travelling wave tube for they do not get transmitted to the closing elements;
- there is a major reduction in the amount of space occupied.

The details of the window according to the invention, given in FIGS. 4 to 7, will facilitate the understanding of FIG. 8 which shows the two ends of the delay line of a TWT provided with two windows.

Figure 4A:
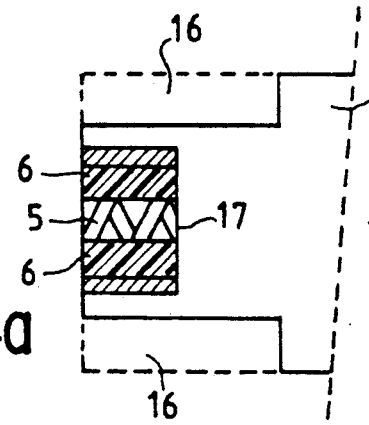
FIGS. 4*a*, 4*b*, 5*a* and 5*b* show longitudinal and cross-sectional views of the modifications made to the chamber of the helix according to the invention.
Figure 4B:
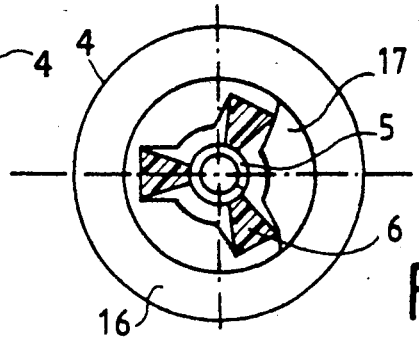

FIG. 4 gives an external and axial view of one end of the delay line 1, without its electron beam focusing device 7+8. The chamber 4 is machined, at least at one end, to form a clearance 16 that forms the housing of the window. Furthermore, an aperture 17, which crosses the chamber 4 throughout its thickness, will enable the helix 5 to be reached for the contact with the external transmission circuit.

Figure 5A:
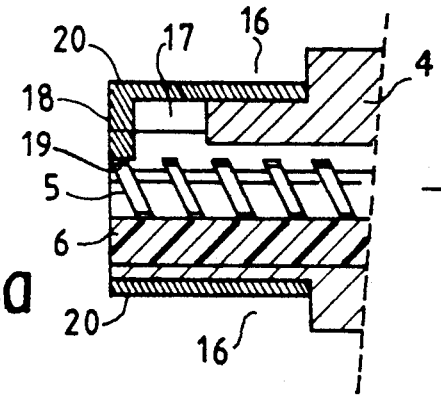
Figure 5B:
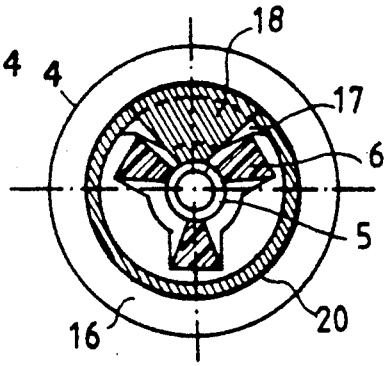

FIG. 5 shows the section of FIG. 4, but with a rotation by 90 degrees for convenience's sake. The antenna, which enables radiation through the window, is formed by a metallic strip 18, brazed at 19 to the end of the helix 5, and connected, at right angles, with a metallic cylinder 20 which fits and is brazed to the chamber 4 in the clearance 16. Of course, the strip 18 penetrates up to the helix 5 through the aperture 17.

Figure 6A:
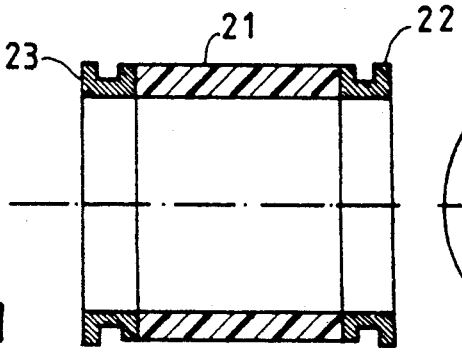
FIG. 6*a* and 6*b* show a sectional view of a vacuum-tight window according to the invention.
Figure 6B:
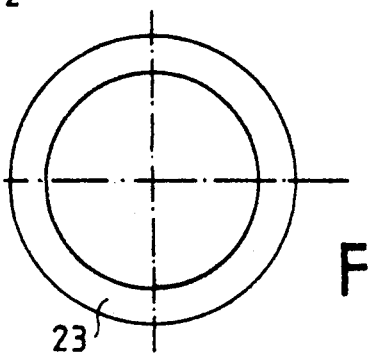

The window itself is shown in FIG. 6. It is a hollow dielectrical cylinder 21, each end of which is brazed to a metallic flexible ring 22 and 23. The constituent material of the window is known per se, and may be chosen from among the materials with which the Pill Box windows are made.

Figure 7A:
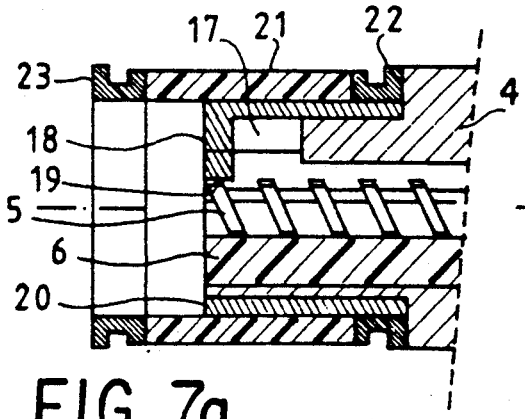
FIG. 7*a* and 7*b* show the matching of a window to an end of a helix chamber, according to the invention.
Figure 7B:
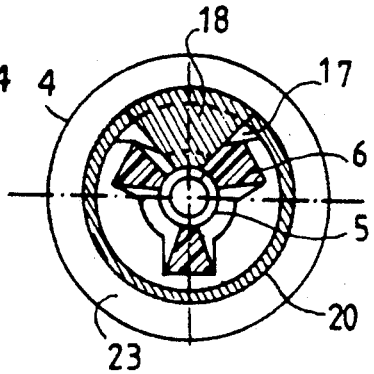

The length, along the axis, of the assembly formed by the ceramic cylinder 21 and the two flexible rings 22 and 23 is greater than the length of the clearance 16 machined in the chamber 4 of the delay line, so that at least one part of the window extends the delay line. This enables the window to be brazed to a source or collector sub-assembly The common internal diameter of the dielectric tube 21 and of the rings 22 and 23 corresponds to the external diameter of the cylinder 20, so that this sub-assembly is sealed to the base of the cylindrical clearance 16 of the chamber 4. The unused flexible element 23 is designed for the connection either with the chamber of the electron gun, in the case of the HF input, or with the collector in the case of the HF output. FIG. 7 shows a simplified view of the assembly.

Besides, the external diameter of the window 21 is slightly smaller than that of the chamber 4 of the helix 5, so as to prevent any friction when it is inserted into the focusing unit. For, metallic dust could get encrusted in the dielectric cylinder and permanently disturb the electrical performance characteristics of the assembly.

FIG. 8 shows the two ends of a TWT delay line provided with two windows according to the invention. The end of the source side (to the right in the figure) is provided with an HF input on a coaxial line 24, and the end of the collector side (to the left in the figure) is provided with an HF output on a waveguide 25. The flexible rings 23, which were not yet used in FIG. 7, are each brazed to a source or collector sub-assembly, 26 or 27, which is coaxial with the delay line 1.

Thus, the parts under vacuum are reduced to the minimum since they concern solely the set of elements designed for the beam, namely the electron gun (emission), the delay line (trajectory and interaction with the microwave) and the collector (for the collection of the electrons).

The vacuum is thus easier to obtain, and the risks of leakage are greatly reduced. In the prior art, the external transmission circuits comprise a window, which is integrated in the case of a coaxial line, and subjected to high stresses, thus entailing a risk of leakage, when it is connected to the circuit conveying or collecting the microwave signal. These risks more particularly concern the more "brittle", coaxial type windows. This drawback no longer exists with the window integrated with the delay line.

It has to be noted that, before the final brazing step, the vacuum-tight "delay line and window" assembly is totally independent of the focusing unit and of the external transmission circuit with which it is associated, as shown in FIG. 7.

It is thus possible to separately braze the vacuum-tight sub-assembly of the delay line, on the one hand, and the sub-assembly formed by the focusing unit and the external transmission circuit, on the other hand, thus enabling the entire system to be checked after the positioning of the vacuum-tight assembly of the helix.

In the event of any imperfection, the faulty sub-assembly alone is replaced The final brazing is done only after this check.

FIG. 8 brings out the fact that, after assembly, the windows 21 have a diameter which is slightly smaller than that of the housing of the chamber 4 of the delay line, so as to prevent any deterioration by metal dust if any.

A microwave window according to the invention works by antenna effect. The metallic strip 18, connecting one end of the helix 5 to its chamber, is connected to a cylinder 20 which, by radiation through the cylindrical window 21, receives energy in the case of the external circuit corresponding to the HF input, or transmits energy in the case of the external circuit of the HF output.

Besides, the two known causes of reflection or mismatching, namely the helix/external circuit junction and the window, ar geometrically identified according to the invention. Hence, there is no longer other than one cause of possible reflection, whence the possibility of improved wideband performance characteristics.

Measurements have been made in the 22–33 GHz frequency band, with a coaxial line as an external input circuit and a guide WR 34 as an external output circuit, on a TWT provided with windows according to the invention.

The thickness of the cylindrical wall of the window 21 is 0.35 mm., and the difference between the radius of the window and that of the helix chamber is 0.05 mm.

The dielectrical performance characteristics obtained correspond to a maximum standing wave ratio of 1.3 in a frequency band of 15% with respect to the central frequency chosen.

What is claimed is:

1. A vacuum-tight window for a microwave electron tube, said tube comprising, firstly, a zone under vacuum, form by a source of electrons, a focusing unit called a "delay line" and a collector of electrons and, secondly, at least one external transmission circuit through which a microwave signal interferes with the beam of electrons crossing said delay line, which is cylindrical, wherein said vacuum-tight window is cylindrical and is coaxial with a chamber which encases the delay line, and integrated with said chamber by brazing and wherein said window is made of ceramic material transparent to microwaves and further comprising a metallic flexible ring at each of the ends of said ceramic cylinder with a first ring being brazed to the chamber of the delay line and the second ring being brazed to at least one of said source and a collector sub-assembly coaxial with the delay line and wherein a microwave transmission antenna in the form of a metallic cylinder passes through the ceramic of the window with said antenna being formed by a metallic strip connected, at right angles, to said metallic cylinder which fits a clearance inserted in the chamber.

2. A window according to claim 1, wherein said window is integrated with the chamber of the delay line, through a clearance inserted in the chamber, the length of said clearance being smaller than the length of the window provided with its two flexible rings.

3. A window according to the claim 1 wherein the metallic strip penetrates the delay line through an aperture that crosses the chamber throughout said chamber thickness.

4. A travelling wave tube having at least one vacuum-tight window according to any one of claims 1, 2 and 3 and further comprising a metallic helix centered in the delay line by a plurality of ceramic supports, wherein the metallic strip of at least one vacuum-tight window is brazed to one end of said helix.

5. A travelling wave tube according to claim 4, wherein the external diameter of the vacuum-tight window is smaller than the external diameter of the delay line.

6. A travelling wave tube according to claim 4, wherein the vacuum-tight window separates the region under vacuum from at least one external vacuum circuit, coaxial line or waveguide, at a pressure which is different from that of the region under vacuum.

* * * * *